US008376365B2

(12) United States Patent
Walker

(10) Patent No.: US 8,376,365 B2
(45) Date of Patent: Feb. 19, 2013

(54) TARGET MEMBER

(76) Inventor: Brett Walker, Leicester (GB)

( * ) Notice: Subject to any disclaimer, the term of this patent is extended or adjusted under 35 U.S.C. 154(b) by 190 days.

(21) Appl. No.: 12/735,841

(22) PCT Filed: Feb. 18, 2009

(86) PCT No.: PCT/GB2009/000432

§ 371 (c)(1),
(2), (4) Date: Oct. 22, 2010

(87) PCT Pub. No.: WO2009/103961

PCT Pub. Date: Aug. 27, 2009

(65) Prior Publication Data

US 2011/0024986 A1 Feb. 3, 2011

(30) Foreign Application Priority Data

Feb. 19, 2008 (GB) ..... 0803081.9

(51) Int. Cl.
*F41J 3/00* (2006.01)

(52) U.S. Cl. ..... 273/403

(58) Field of Classification Search ..... 273/403–410
See application file for complete search history.

(56) References Cited

U.S. PATENT DOCUMENTS

| | | | | | |
|---|---|---|---|---|---|
| 4,066,261 | A * | 1/1978 | Stewart | 273/403 |
| 4,813,684 | A | 3/1989 | Bruno | |
| 5,308,084 | A | 5/1994 | Morrell | |
| 5,427,382 | A * | 6/1995 | Pate et al. | 273/403 |
| 5,503,403 | A * | 4/1996 | Morrell | 273/403 |
| 5,649,708 | A * | 7/1997 | Podlesny | 273/403 |
| 6,068,261 | A * | 5/2000 | Nettle | 273/408 |
| 6,254,100 | B1 * | 7/2001 | Rinehart | 273/403 |
| 6,926,281 | B1 * | 8/2005 | Woock | 273/403 |
| 6,983,939 | B2 * | 1/2006 | Pulkrabek | 273/403 |
| 7,744,090 | B1 * | 6/2010 | Nettle | 273/403 |
| 2004/0108659 | A1 | 6/2004 | Pulkrabek | |
| 2007/0029733 | A1 | 2/2007 | Anderson | |

FOREIGN PATENT DOCUMENTS

| | | | |
|---|---|---|---|
| DE | 4302490 | A1 | 9/1993 |
| FR | 2438249 | A | 4/1980 |
| GB | 0803081.9 | | 6/2008 |
| NL | 1029025 | | 11/2006 |
| NL | 1029025 | C1 | 11/2006 |
| WO | WO 90/15964 | A | 12/1990 |
| WO | PCT/GB2009/000432 | | 6/2009 |

* cited by examiner

*Primary Examiner* — Mark Graham
(74) *Attorney, Agent, or Firm* — Wells St. John, P.S.

(57) ABSTRACT

A target member which may be used in conjunction with sporting activities, such as archery, comprising a housing (20, 21) having an outer surface which forms a portion of a target during use, the outer surface having an aperture (18) therein. The target member also comprises a degradable component (22) which is positionable within said housing such that at least a portion of said second component is exposed by said aperture (18). The exposed portion of said degradable component (22) forms part of the target and the degradable component (22) is repositionable upon degradation of the exposed portion through use of the target so as to expose a further portion of said second component (22) by said aperture (18) for further use.

15 Claims, 7 Drawing Sheets

TARGET MEMBER

CROSS REFERENCE TO RELATED APPLICATION

This application is a 35 U.S.C. §371 of and claims priority to PCT International Application Number PCT/GB2009/000432 (Publication No. WO 2009/103961A1), which was filed 18 Feb. 2009 (18 Feb. 2009), and was published in English, and this application claims priority to UK Patent Application No. 0803081.9 which was filed 19 Feb. 2008 (19 Feb. 2008), and the teachings of which are incorporated herein by reference.

The present invention relates to a target member and more particularly, although not exclusively, to a target member for use in conjunction with sporting activities.

Whilst the following description proceeds in relation to archery targets in particular, it will be appreciated that the present invention may be applicable to any activity, which results in the degradation of a target or a section of a target during use. Such activities, by way of example, may involve the use of a target to determine the accuracy with which a user has thrown, fired or otherwise propelled a projectile at the target.

The repeated use of a target for such activities can result in the target or at least a section of the target becoming degraded. In the example of archery, the penetration of an arrow into a target causes indentations to be formed.

The repeated shooting of arrows at a particular area of a target thus causes inconsistencies in the target surface which can lead to a through hole being formed in the target. In such an instance, the target becomes redundant since it can no longer retain the arrow in order to determine the accuracy with which the arrow was propelled. In addition, the formation of a through hole represents a danger for anyone or anything situated behind the target.

The need to change targets during competitions in particular can be disruptive, time consuming and can distract competitors.

It is an object of the present invention to provide a target member, which allows for extended use before replacement of the target member is required.

According to one aspect of the present invention there is provided a target member comprising a first component having an outer surface which forms a first section of a target during use, the outer surface having an aperture therein, and a second component movably positionable relative to said first component such that at least a portion of said second component is exposed by said aperture, the exposed portion of said second component forming a second section of the target during use, wherein the second component is repositionable upon degradation of the exposed portion through use of the target so as to expose a further portion of said second component by said aperture.

It is to be understood that the term 'target member' as used within this application is not intended to be limited to only a single part but may encompass one or more component parts of a target or else the target in its entirety.

The present invention is advantageous in that an entire target does not need to be replaced due to degradation of one or more areas thereof. Instead, the second component can simply be repositioned to expose a fresh target section for reuse of the target. Typically the second component defines a focal area of the target. Thus the target section defined by said second component is most likely to become degraded through use.

In one embodiment, the orientation of the second component can be varied relative to the first component. The second component may be three-dimensional in form and, in one embodiment, the second component may have a curved surface. The second may be rotatably positionable relative to the first component. Rotation of the second portion allows a different surface or surface portion of the second component to be exposed through the aperture.

The second component may have an axis of rotation. The second component may be substantially spherical, cylindrical, drum-shaped or ellipsoid in form or any other polyhedral shape.

The freedom of movement of the second component relative to the first component may be limited during use. The second component may be releasably held relative to the first component and, when held, the freedom of movement of the second component relative to the first component may be limited to rotation only. In this embodiment, a used or degraded portion of the second component can simply be turned away from the aperture so as to expose a fresh portion of the second component for subsequent use.

The first component may form at least part of a housing for said second component. The first component may comprise opposing housing portions. Either or both of the housing portions may be shaped to provide an interior recess or cavity, within which the second component can be received. Each of the opposing housing portions may be shaped to provide a cavity portion such that, when the opposing sections are brought together, they define an enclosure for the second component.

The enclosure or cavity for the second component may be shaped to closely surround the second component. The second component and the cavity are typically correspondingly shaped.

The outer surface forming the first section of the target may be a surface of a first housing portion. The aperture in the outer surface may open into a cavity or recess or a portion thereof for receiving the second component.

The first component may take the form of a three-dimensional body. The body may be tapered in section. The body may taper away from the outer surface in one orientation. The body may taper towards the outer surface in one orientation. The body may be doubly tapered such that the body tapers away from the outer surface in a first orientation and towards the outer surface in a second orientation. The first and second orientations may be spaced by 90°. The first and second orientations may relate to vertical and horizontal planes.

The use of tapered surfaces is advantageous in that they can be used to abut against a correspondingly tapered surface so as to prevent movement of the target member during use. A doubly tapered body can be used to lock the target member within a support which may comprise the remainder of the target.

The target member may be locatable within a support. The target member may be positionable within a larger target such that the target member forms only a portion of the target surface. The target member may comprise locating means for removably locating the target member within a target or other support. The locating means may comprise one or more formations along one or more edges of the target member which are alignable with a corresponding formation on the support or remainder of the target. Suitable formations may comprise one or more projections or recesses, such as, for example, a tongue, lip, ridge, flange or groove formation.

The locating means may be formed as one or more separate location members arranged to be interposed between the target member and the remainder of the target or support. The locating means may have a face arranged for abutment with a tapered face of the target member body.

According to one embodiment, the first component may comprise a plurality of apertures arranged to expose a plurality of portions of one or more second components. A plurality of second components may be provided such that one second component is provided for each aperture. The first component may house multiple second components. The first component may have a plurality of recesses or cavities corresponding to the number of second components to be housed therein.

In one embodiment, the target member is reversible. The first component may have a second outer surface and the target member may be positionable such that the second surface forms at least a portion of the target instead of said first outer surface. The second outer surface may or may not have an aperture therein. The first or second surface may serve as a practice or competition target surface. The second surface may have one or more apertures therein dependent on practice requirements.

According to a further aspect of the present invention there is provided a target member comprising a first component having an outer surface which forms a first section of a target during use, and a second component movably positionable relative to said first component between a first and at least one further position for use, said first position presenting a first portion of the second component for degradation through use of the target, wherein the first component comprises a housing arranged to releasably retain the second component relative to said outer surface for use, such that upon degradation of the first portion of the second component, the second component is repositionable so as to present a further portion of said second component for subsequent use.

Typically the second component comprises a resiliently degradable material such as a foam. The second component may comprise a plurality of layers of material.

According to a third aspect of the present invention, there is provided a target comprising a removable target member according to the first aspect.

Preferred embodiments of the present invention are described in further detail below by way of example with reference to the accompanying drawings, of which:

Figure 4:
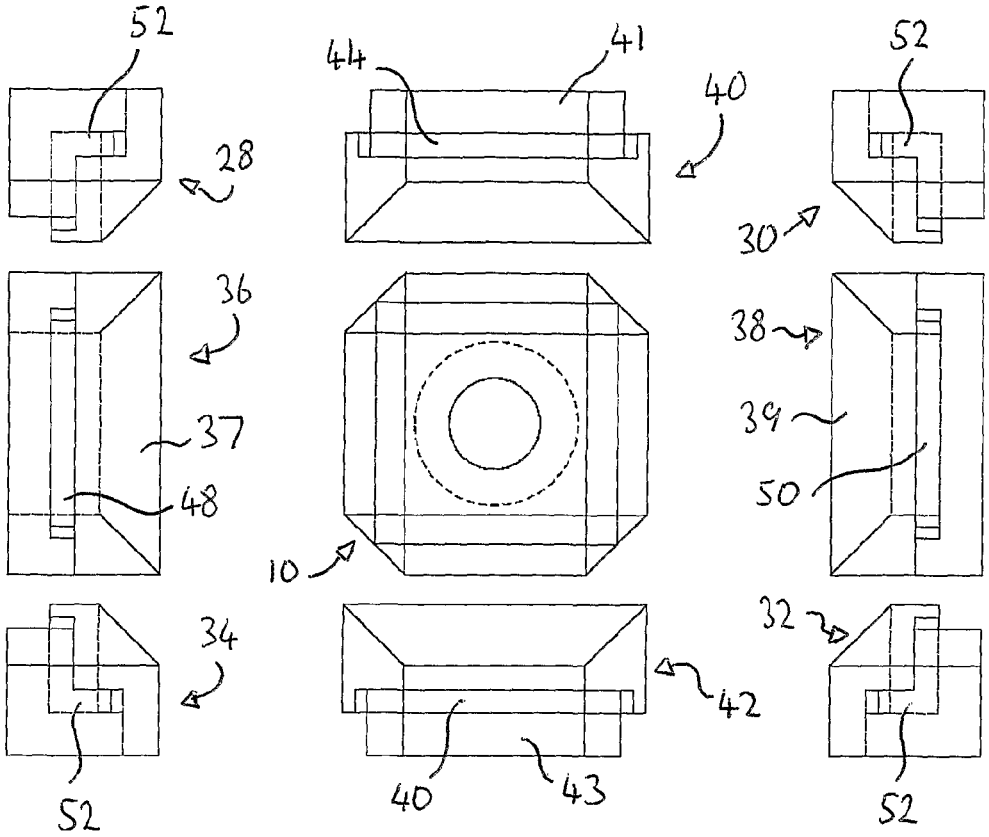
FIG. 4 shows a wireframe front view of further detail of the locating formations.
Figure 5A:
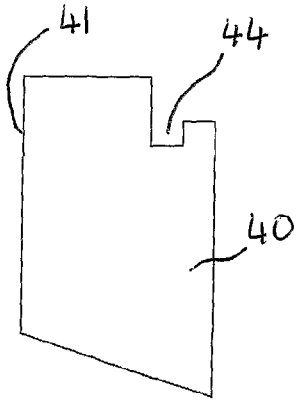
Figure 5B:
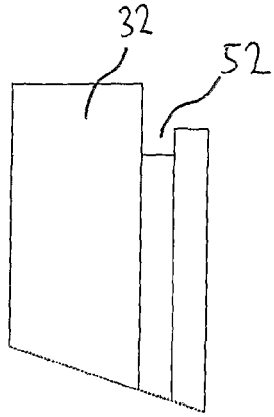
Figure 5C:
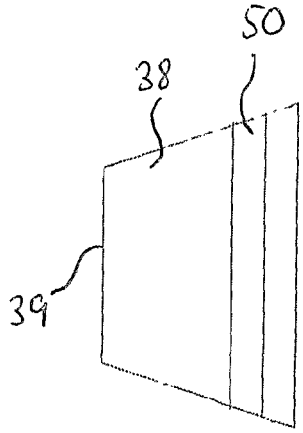
Figure 6:
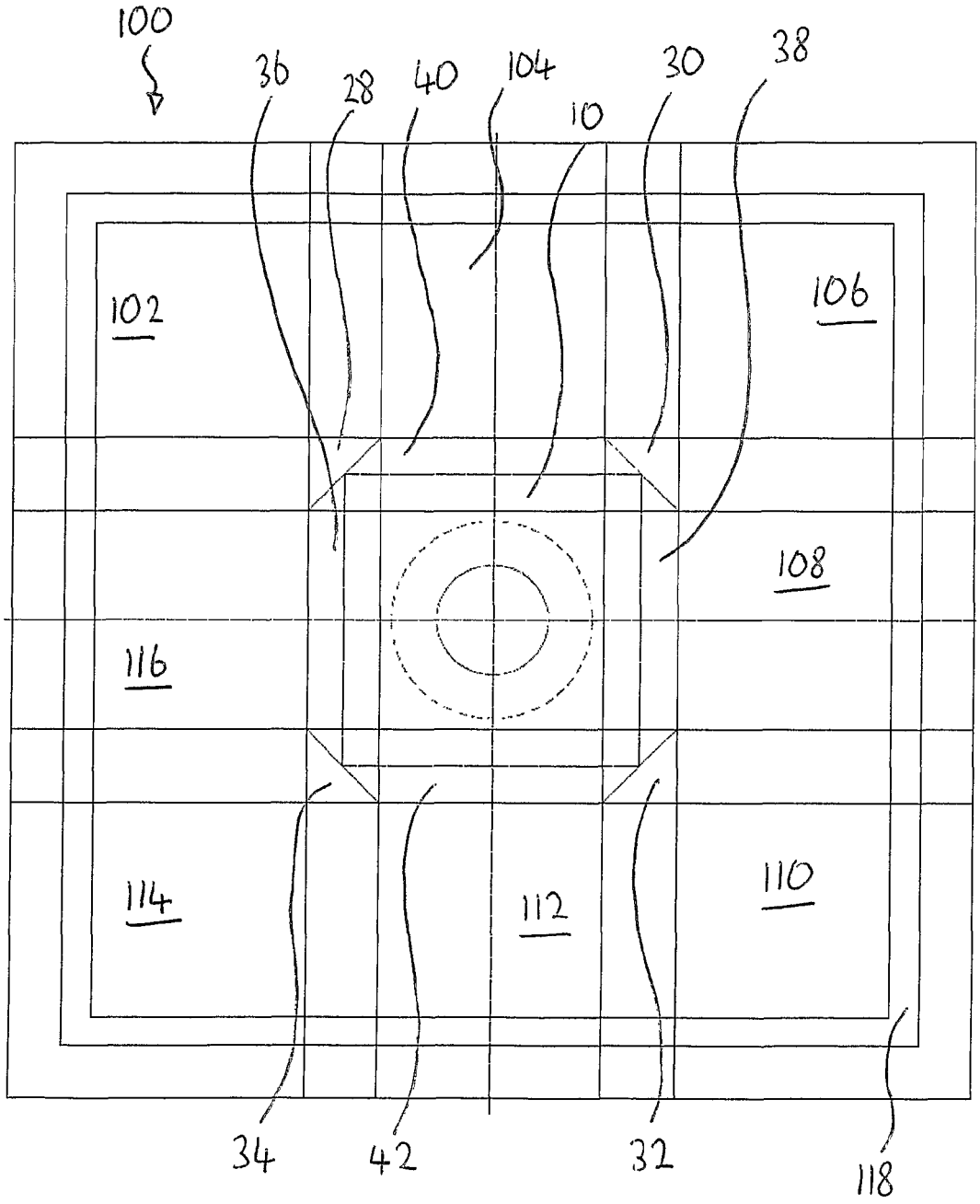
Figure 7:
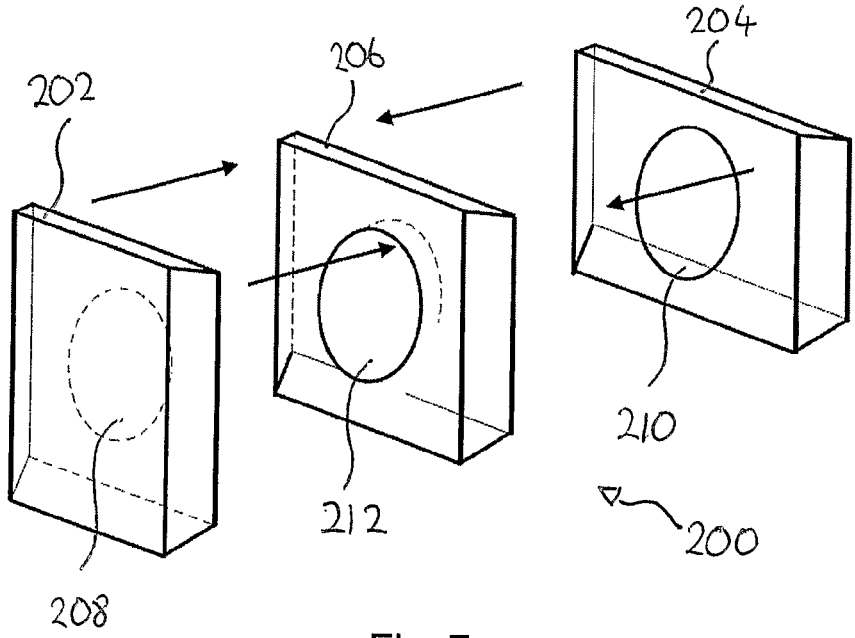
Figure 8:
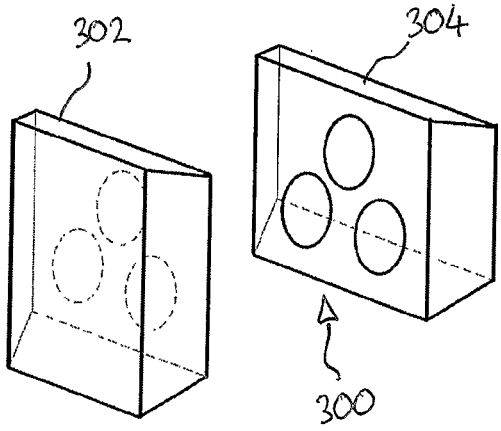
Figure 9:
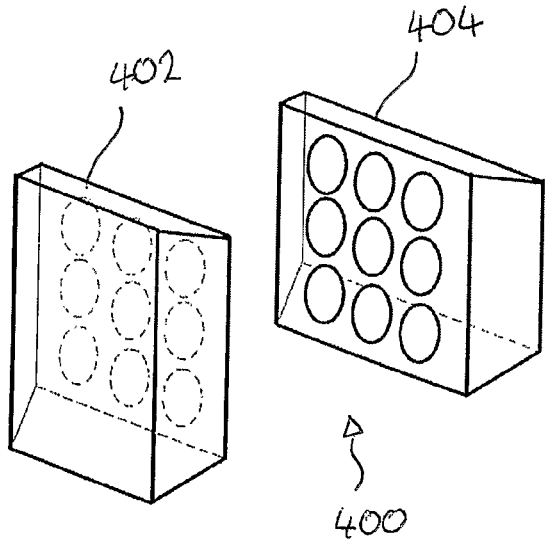
Figure 10:
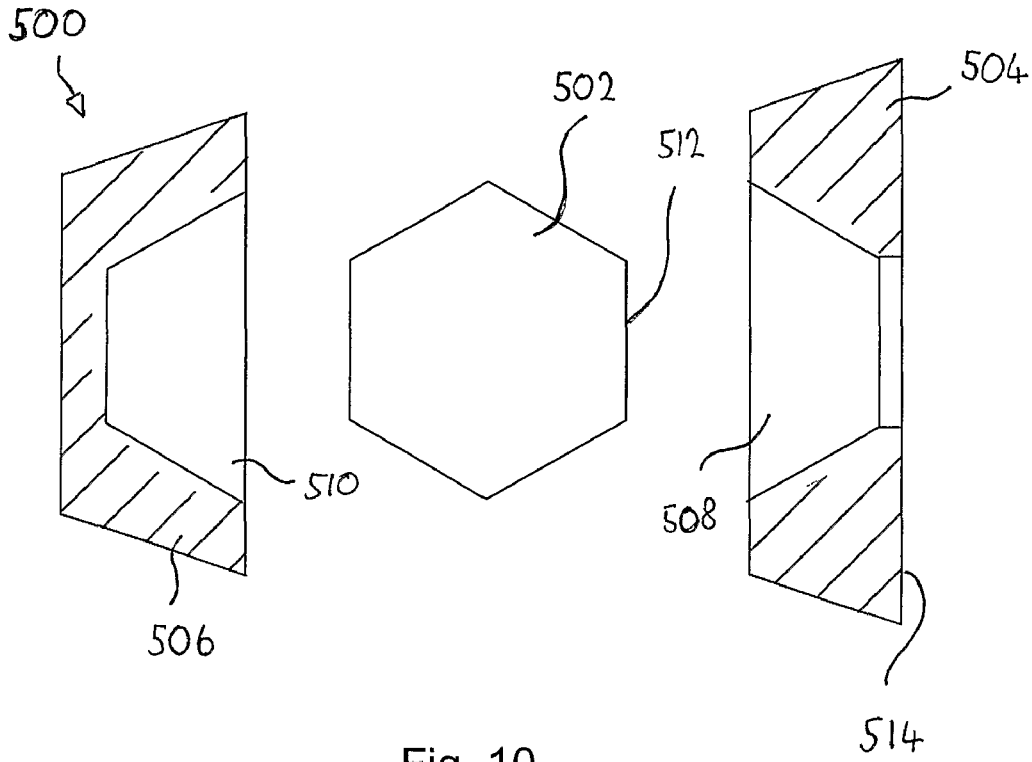
Figure 11:
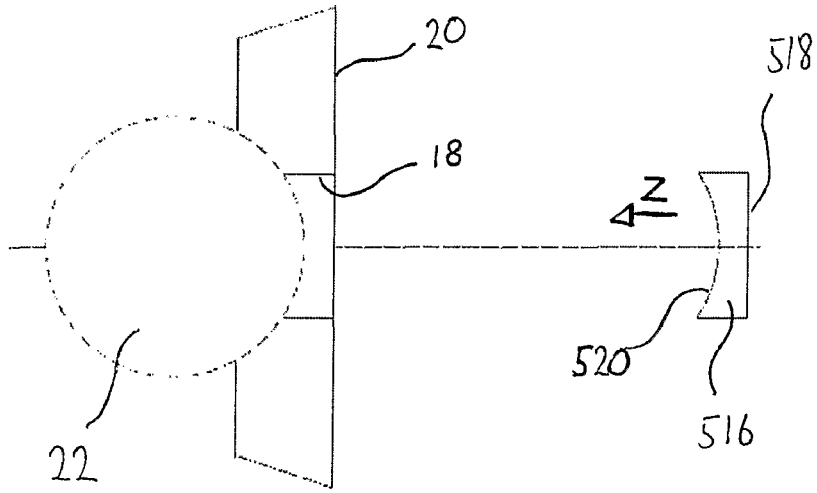
Figure 12:
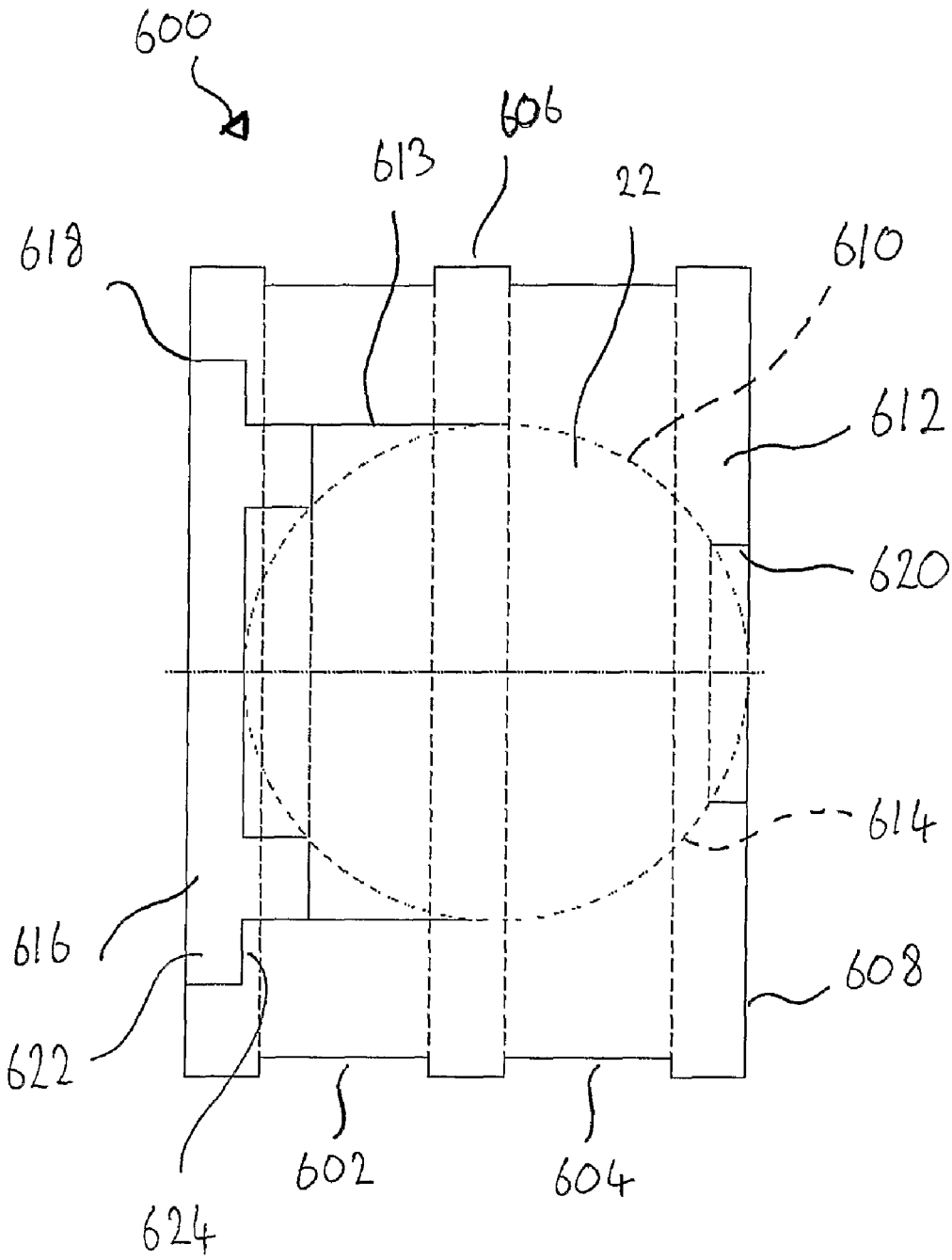

FIG. 5A-C show side views of certain locating formations of FIG. 4;

FIG. 6 shows a wireframe view of the target member within a larger target structure;

FIG. 7 shows a target member according to a further embodiment of the present invention;

FIG. 8 shows a target member arrangement according to another embodiment of the present invention;

FIG. 9 shows a further target member arrangement according to the present invention;

FIG. 10 shows a cross sectional view of a target member having a polyhedral second component;

FIG. 11 shows a cross sectional view of part of a target member having an insert; and, FIG. 12 shows a sectional view of a target member according to a further embodiment of the present invention.

Figure 1:
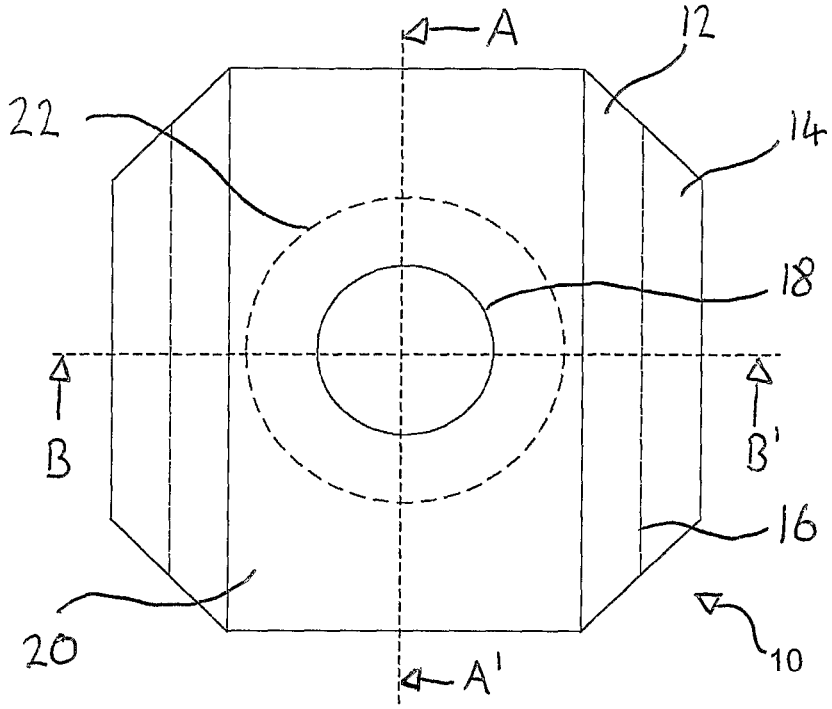
FIG. 1 shows a three-dimensional view of a target member according to the present invention from the front.

Turning firstly to FIG. 1, there is shown a target member according to one embodiment of the present invention. The target member comprises a first component in the form of a target block 10 comprising a front member 12 and a rear member 14. The front 12 and rear 14 members are in contact in a plane shown by join line 16 in FIG. 1.

The front member 12 has an aperture 18 in the frontal surface thereof as per the orientation of the target block 10 shown in FIG. 1. In this embodiment, the aperture 18 is located at the centre of a frontal face 20 of the front member 12 and is generally circular in shape. However it will be appreciated that the shape and location of the aperture 18 may vary according to target requirements.

A ball or sphere of resilient material 22 is shown in phantom in FIG. 1 and is contained within the target block 10. The dimensions of the ball 22 are greater than that of the aperture 18 such that the aperture exposes only a portion of the ball 22 housed within the block 10. The ball 22 is intended to be degradable or sacrificial during repeated use of the target.

The block is generally symmetrical about axes A-A' and/or B-B'. In accordance with the orientation of FIG. 1, the axes A-A' and B-B' represent generally horizontal and vertical axes respectively, although it will be appreciated that the symmetry of the block 10 is preserved regardless of whether those perpendicular axes are rotated to a different orientation about the aperture 18.

Figure 2:
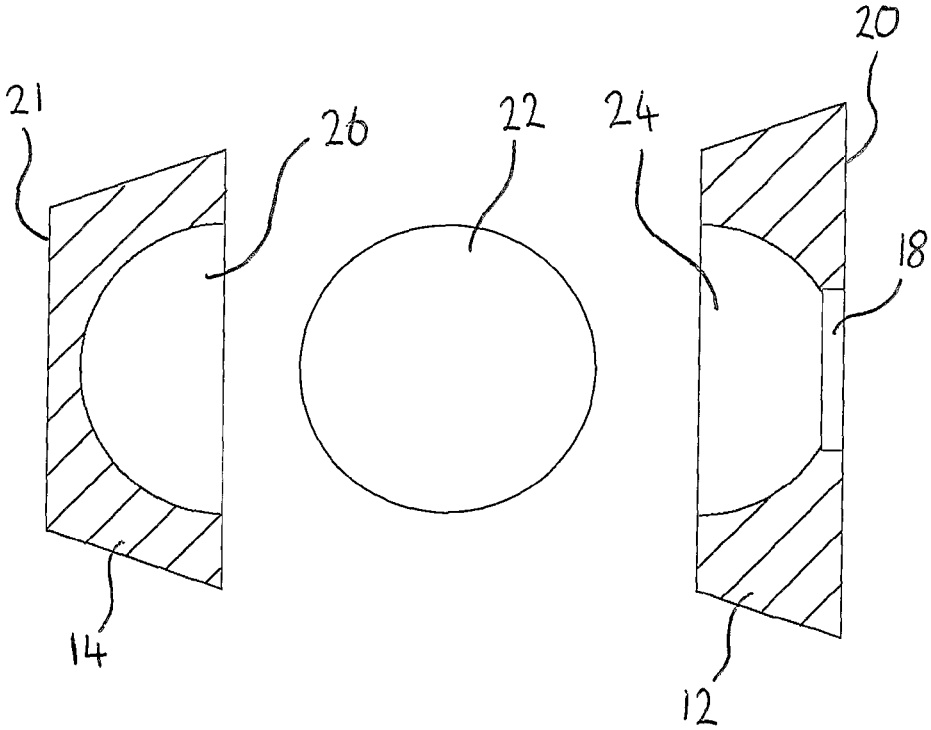
FIG. 2 shows an exploded sectional view of the target member of FIG. 1 taken along the plane A-A' in FIG. 1.

Turning now to FIG. 2, there is shown a cross sectional view of the block 10 of FIG. 1. The front 12 and rear 14 members of the block 10 are separable as shown in FIG. 2 so as to selectively release the ball 22 from the block.

Each of the front and rear members are shaped to provide an internal cavity formation within the block once formed. In this regard, the front block 12 has a recess 24 and the rear block has a recess 26. Each of the front and rear recesses are shaped to enclose a portion of the ball 22, such that when they are brought together as shown in FIG. 1, the combined recesses closely enclose the ball 22. In this particular embodiment, the recesses are substantially hemispherical but may be any suitable shape to closely enclose the component housed therein.

Whilst a spherical shape represents a preferred embodiment of the second component, it will be appreciated that other shapes are possible, such as, for example, a polyhedral. In such an embodiment the interior cavity within the block 10 will typically be modified to match the shape of the component located therein. In one embodiment, the second component may comprise, a pyramid, a hexahedral shape such as a cube, or else any other suitable polyhedral as described in relation to FIG. 10 below.

As shown in FIG. 2, the aperture 18 opens into the recess 24 of the front member 12.

The target block 10 is tapered as can be seen in FIGS. 1 and 2. In particular, the front face 20 is taller and narrower than the rear face 21, which is broader but shallower. Thus the target block 10 tapers rearwardly in a vertical sense from the front to the rear face. However the block tapers in the opposite sense from the rear face to the front face in a horizontal plane as can be seen in FIG. 1. This dual taper can be seen more clearly in FIG. 3 and allows the block to be constrained within the target such that it is inhibited from movement in both forward and reverse directions.

The second component contained within the target block may be formed of a resilient material such as for example a rubber or foam material. The second component may be formed of one or more polymer materials which may comprises polymers foams. In one embodiment, the target or first component may be formed of polyethylene foam and the second component may be formed of polyurethane foam. In an alternative embodiment each of the first and second components may be formed of a silicon-based foam material.

Each component may be formed of multiple layers. A first or outer layer may have different material properties to another layer. For example, the layers may have different densities. According to one particular embodiment, the densities of adjacent material layers may alternate between harder and softer layers. In one embodiment, the different layers of material may be coloured differently such that as one layer becomes degraded through use, an alternatively coloured layer becomes visible. This feature may serve to indicate when a component has become sufficiently degraded such that replacement or movement of the component is required. Typically the outermost colour will be yellow for archery but any other colour may be suitable.

It is envisaged that the number of layers may vary from one to ten dependent on the requirements of the target. However it should be noted that each individual layer may be a laminate and may be formed of a plurality of layers such that the total number of individual layers may be significantly greater than ten. The discontinuities or joins between adjacent layers have been found to have a beneficial impact on the properties of the target components since they can help arrest motion of an arrow or other projectile.

Figure 3:
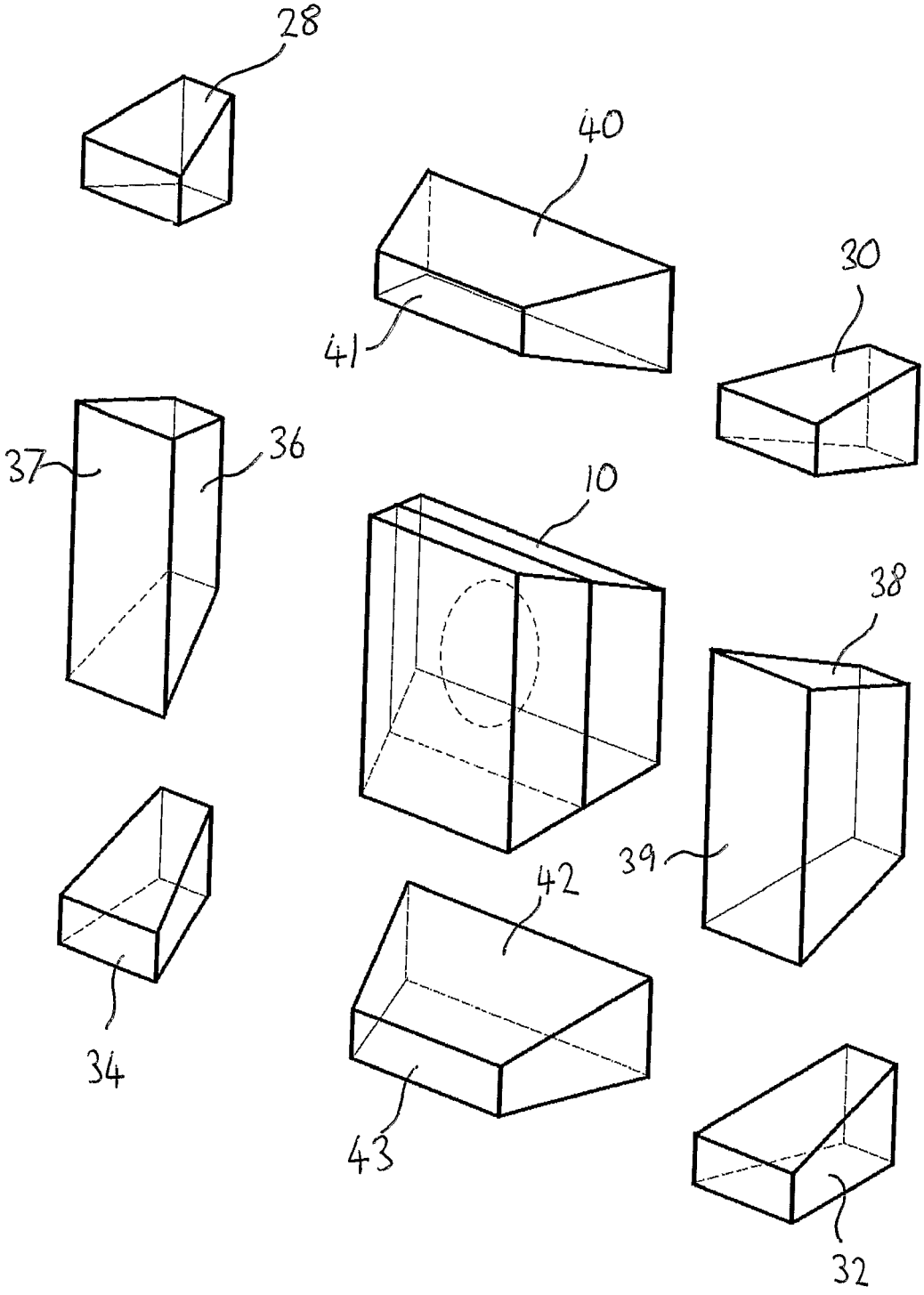
FIG. 3 shows an exploded three-dimensional view of the target member and associated locating formations.

Turning now to FIG. 3, there is shown the target block 10 and a plurality of locating members to allow location of the target block 10 within a larger target or other support means. The locating members of FIG. 3 are simplified to show their basic geometric shapes relative to the target block 10.

The locating members comprise corner members 28, 30, 32 and 34 arranged to be located at the corners of the target block 10. In this embodiment, the locating members 28 and 32 may be identical but rotated through 180°. The locating members 30 and 34 may also be identical but rotated through 180°. Locating members 28 and 32 may be a mirror image of members 30 and 34.

The locating members additionally comprise side members 36 and 38 located on the left and right hand sides of the block 10 respectively, as well as an upper 40 and lower 42 locating members above and below the block 10.

Each of the locating members is trapezoidal in section. Each locating member has at least one tapered or oblique edge to accommodate the taper of the target block. When all the locating members are correctly positioned in abutment with the target block 10, the outer profile of the combined locating members forms a rectangle or square. This shape can conveniently be held within a larger target or support.

To this end, the side members 36 and 38 taper from broader frontal face 37 and 39 to a narrower rear face and the upper and lower blocks 40 and 42 taper from a deeper rear face to a shallower front face (41 and 43 respectively). Thus each of the locating members adjacent a face of the target block taper in an opposite direction to the taper of the adjacent target block face. Accordingly the opposing faces of the target block and the locating members abut each other over a substantial area of each face.

The corner blocks 28-32 taper to accommodate the shape of the upper 40, lower 42 and side 36, 38 blocks such that the combined target block and locating members fits snugly within a right-angled frame.

Further details of the locating blocks according to a preferred embodiment are shown in the wireframe view of FIG. 4. Here it can be seen that each of the locating members is shaped so as to provide a peripheral groove or slot about the perimeter of the target block.

To this end each of the locating members has a front and rear face. A discontinuity or channel is provided in each locating member between the front and rear faces. In the case of the upper member 40, the discontinuity 44 runs across the width of the member. Similarly the discontinuity 46 runs laterally across the locating member 42. In the side members 36 and 38, the respective discontinuities 48 and 50 run vertically between upper and lower edges of the member. Within the corner members 28 to 34, each discontinuity 52 extends about the corner of the relevant member. That is to say that the discontinuity changes direction about substantially 90° as it passes through that member.

A side view of the relevant discontinuities taken from the right hand side of the arrangement shown in FIG. 4 is shown for member 40 in FIG. 5A, for member 30 in FIG. 5B and for member 38 in FIG. 5C. Thus it will be appreciated that, when the locating members are located against the target block 10 in the orientations shown, the combined discontinuities 44, 46, 48, 50 and 52 of the locating members form a channel or groove extending about the periphery of the target block 10. This acts to provide a locating formation for positioning and retaining the target block 10 within a target as shown in FIG. 6.

FIG. 6 shows a wireframe front view of a target 100 comprising target block 10. The target 100 is shown in wireform to enable visualisation of the overlap between the constituent target sections. The central target section is formed of the target block 10 and the associated location members 28-42 as described above. The remaining target sections 102, 104, 106, 108, 110, 112, 114 and 116 are located about the central section to form a rectangular target 100.

The target sections are generally rectangular in profile. Each of sections 104, 108, 112 and 116 have an inner face which abuts against an outer edge of the centre section which is also rectangular in profile. Whilst the frontal face of the target block may be an elongate rectangular surface as shown in FIG. 1, the provision of locating members 28-42 results in a central target section having a generally square target surface.

Each of the target sections has a tongue or lip formation extending about an edge thereof so as to allow interlocking with the peripheral groove about the central target section formed by the peripheral shape of the locating members 28-42. Thus once the central section is slotted in the target 100 it is securely held in place by the interaction of corresponding tongue and groove formations of the locating members and adjacent target sections. Similarly the adjoining edges of sections 102, 106, 110 and 114 interlock with the adjacent edges of sections 104, 108, 112 and 116 to form a rigid target.

The target 100 also has a peripheral groove or slot 118 running about its perimeter such that the target 100 can be securely held within a frame (not shown) which is typically rectangular in shape. The frame is removably appendable about the target 100 so as to allow the target sections to be locked in place. When the frame is removed, the individual sections 104, 108, 112 or 116 can be removed by sliding those sections outward in order to allow access to the target block 10.

The target block 10 can thus be removed and opened whenever necessary in order to replace or rotate the component 22 when it has become degraded through use. In one embodiment, the component 22 may be removed, rotated and reinserted for subsequent use.

Whilst the preferred embodiment shows the use of a larger target 100 in FIG. 6, it will be understood that the central target section alone may be constrained within a suitable frame or other support by the use of, for example, straps or else grooves in the side walls of the target block.

It is also envisaged that the component 22 may be manually rotated whilst retained within the target block 10 by manipulation through aperture 18. Thus the component 22 may be loosely held within the target block 10 such that a small tolerance is factored into the design of the interior cavity to allow constrained movement of the component 22 therein. An arrow or other article embedded within the component 22 may be used to manipulate the component relative to the aperture 10.

The target shown in FIG. 6 provides a rectangular target area. However it will be appreciated that any size or shape of target may be provided, such as another polygonal shape. Further examples may include other geometric shapes or else shapes of target intended to represent the silhouette of an animal or else a three-dimensional representation of an animal.

In either embodiment, an outer flange of target material extends around the periphery of the target to prevent the wooden frame being hit by a projectile.

Turning now to FIG. 7, an alternative embodiment to the target block 10 is shown at 200. In this embodiment the target block 200 is formed of three members instead of the two members shown in FIGS. 1 and 2. Each of the target block members may be formed of a laminate material or else a substantially uniform body of material.

The three members of this embodiment comprise a front member 202, a rear member 204 and an intermediate member 206, arrange to be disposed therebetween during use. An aperture and recesses 208 and 210 are provided in the front and rear members similar to the recesses shown in FIGS. 1 and 2. However in this embodiment, the intermediate member has a recess 212 extending completely therethrough in order to allow the ball 22 to be retained therein.

Apart from the differences described above, the embodiment of FIG. 7 is similar to that of FIGS. 1 and 2 in outer form, such that the outer taper of the block 200 once formed is substantially the same as that of block 10. Accordingly, block 10 and block 200 are to be considered interchangeable within the target 100 described above.

In FIGS. 8 and 9, further embodiments are shown in which a plurality of recesses are shown in the blocks 300 and 400 respectively. In FIG. 8, members 302 and 304 each comprise three recess formations in order to allow insertion of three degradable components 22 therein.

In FIG. 9, members 402 and 404 each comprise nine recess formations therein in order to allow insertion of nine degradable components 22. The degradable components for insertion into the target blocks 300 or 400 of FIGS. 8 and 9 may be smaller than the degradable component of FIGS. 1 and 2. As with FIG. 7, the embodiments of FIGS. 8 and 9 are otherwise similar to the embodiment of FIGS. 1 and 2 and are interchangeable therewith.

Any of the embodiments described above may be reversible in that the target block may be mounted in the target in either a forward or else a reverse direction. The surface having aperture 18 may be used for practice, whilst the opposing surface 21 may omit an aperture and may be used for competitions.

The embodiments of FIGS. 8 and 9 offer an additional advantage in that different apertures may be provided in one of the target block members to the opposing member. For example a single aperture, similar to the arrangement of FIG. 1, may be provided in one outward face of the target block whilst multiple apertures may be provided in the opposing outward face of the target block for alternative practice use. Thus the target block can be simply turned around to switch between different uses.

The multiple cavities of FIGS. 8 and 9 may be arranged within the target block in any pattern or array as required. This may include a triangular array, or else a series of rows and or columns.

Turning now to FIG. 10, a further embodiment of the target block is shown at 500. This embodiment is the same as that described in relation to FIGS. 1 to 6, save that the shape of the inner component 502 as well as the front 504 and rear 506 target block members has been modified.

The inner component 502 is polyhedral in form and in this embodiment is polygonal in section. More specifically, the inner component 502 is hexahedral in section. The component 502 may be a decahedron, dodecahedron or other suitable shape. Accordingly the cavity 508, 510 within each of the target block members 504 and 506 is polyhedral to correspond to a part of the polyhedral shape of the inner component 502.

This embodiment has the benefit that the inner component 502 has a plurality of discrete faces 512 which are easily aligned within the target block. When a face is worn out the inner component is easily realigned for subsequent use. Furthermore, although not shown in FIG. 10, this embodiment allows the face 512 of the inner member to be aligned with the target surface 514 of the target block member 504. Thus the surface of the inner member can be coplanar with the target surface 514 during use. This may be of particular importance for targets to be used in accordance with competition regulations. This feature may also be applied to other polyhedral shapes of inner component, such as, for example, hexahedral components or other suitable shapes.

In FIG. 11, an insert member 516 is shown which may be used in conjunction with any embodiment in which an aperture is provided in the target block. In this embodiment, only the front member of the target block 10 is shown for clarity. The insert member 516 or plug is shaped to fit in aperture 18 in the direction of arrow Z so as to block the aperture, for example during competition use.

The insert member 516 has a flat outer surface such that it can be arranged to be substantially coplanar with the outer surface 20 of the target block. In addition, the insert member has an opposing or inner surface 520 shaped to correspond to the surface of the second component. In this embodiment, the inner surface is shaped to correspond to the contour of the ball 22. The tight fit between the insert member 516 and the aperture 18 ensures that the insert does not easily separate from the target during impact or else when an arrow or projectile is pulled free of the target.

The concept of the insert member may be applied to any of the embodiments described above in which the second component does not sit flush with the outer surface of the target block.

Turning now to FIG. 12, there is shown a target block 600 which may fit directly within a target or support frame without the need for the locating members shown in FIGS. 3 and 4. The target block 600 has one or more channels or grooves formed in the peripheral edges of the target block itself. In this embodiment, the block 600 has a pair of parallel channels 602 and 604 formed therein.

The peripheral edges 606 are generally perpendicular to the front face as opposed to the tapered edges shown in FIGS. 1 to 6.

Also in the embodiment of FIG. 12, the internal cavity 610 is formed within a single body member 612 as opposed to the multiple target block members shown in the previous embodiments. The internal cavity comprises a cylindrical bore section 613 and a curved end section 614 shaped to accommodate the curvature of the ball 22.

An insert member 616 is shaped to block a mouth portion 618 of the body member 612. In this embodiment, the mouth 618 is provided in the opposite face of the body member 612 from the aperture 620. However the mouth 618 and the aperture 620 may be one and the same opening. Additionally one or more apertures may be provided in the insert member 616 to expose portions of the second component 22 during use. Further insert or plug members may be used to block such apertures according to the embodiment of FIG. 11.

The insert member 616 has a shoulder formation arranged to fit closely with a corresponding shoulder 624 in the body 612. The corresponding shoulders may be arranged for friction or interference fit or else may be threaded or have other fitment formations therein to ensure that the insert 616 does not become lose during use.

In any of the embodiments described above, it will be appreciated that the present invention advantageously focuses on a degradable area which is most suspected to degradation through use. Thus it is generally considered unnecessary to replace the outer periphery of a target as often as the focal area, at which the user is intending to hit.

The invention claimed is:

1. A target member comprising:

a housing having an outer surface which forms a section of a target surface during use, and a three dimensional degradable component having a plurality of surface sections suitable for use as a target, the degradable component arranged to be releasably retained within said housing relative to said outer surface for use so as to expose a first surface section of the degradable component for degradation through use of the target, wherein the housing comprises opposing housing portions, either or both of said housing portions having an interior recess within which the degradable component can be received such that, when the opposing housing portions are brought together, they define an enclosure shaped to closely surround the degradable component, and wherein the degradable component is selectively rotatable about a plurality of axes within said enclosure such that upon degradation of the exposed section of the degradable component of the target through use, the degradable component is repeatedly repositionable by rotation about one of its axes of rotation so as to present further, previously unexposed portions for subsequent use; and wherein the degradable component is spherical in shape and the plurality of surface sections suitable for use as a target adjoin one another on the surface of the sphere.

2. A target member according to claim 1, wherein the housing comprises locating formations for removable location of the target member within a support or a larger target.

3. A target member according to claim 2, wherein the housing takes the form of a three-dimensional body which is tapered in section.

4. A target member according to claim 3, wherein the housing body is doubly tapered.

5. A target member according to claim 1, wherein the housing comprises an aperture in said outer surface and said portion of the degradable component presented for use is exposed by said aperture.

6. A target member according to claim 5, wherein the portion of the degradable component presented for use is substantially flush with said outer surface during use.

7. A target member according to claim 1, wherein the housing outer surface forming the first section of the target is a surface of a first housing portion and said surface has an aperture therein which opens into the recess for receiving the degradable component.

8. A target member according to claim 1, wherein the target member comprises locating means for removable location of the target member within a support or a larger target.

9. A target member according to claim 8, where the locating means comprises one or more formations along one or more edges of the target member which are alignable with a corresponding formation on the support or remainder of the target.

10. A target member according to claim 9, wherein the formations comprise a tongue extending around a periphery of the target member.

11. A target member according to claim 1 wherein the housing comprises a plurality of apertures arranged to expose a plurality of portions of one or more degradable components therein.

12. A target member according to claim 1 wherein the housing has first and second outer surfaces, either of the first or second surfaces being selectively positionable to form a target surface section such that the target member is reversible.

13. A target comprising a target member according to claim 1.

14. A target member according to claim 5, wherein the portion of the degradable component presented for use is disposed behind said outer surface during use.

15. A target member according to claim 10, wherein the formations comprise a groove extending around a periphery of the target member.

* * * * *